United States Patent [19]

Thiboutot

[11] 4,243,263

[45] Jan. 6, 1981

[54] COLLAPSIBLE SUPPORT STRUCTURE AND DEVICES FORMED THEREFROM

[75] Inventor: Robert Thiboutot, Lac St. Charles, Canada

[73] Assignee: Les Entreprises Rotot Ltee, Comte de Bellechasse, Canada

[21] Appl. No.: 960,436

[22] Filed: Nov. 13, 1978

[51] Int. Cl.[3] ..... A47C 4/00

[52] U.S. Cl. ..... 297/42; 297/45; 5/176 R; 5/180

[58] Field of Search ..... 297/42, 45, 54; 248/283, 277, 436; 52/645, 646, 109; 5/425, 430, 182, 176, 115, 154, 180; 211/201, 202; 108/113

[56] References Cited

U.S. PATENT DOCUMENTS

| | | | |
|---|---|---|---|
| 1,259,825 | 3/1918 | Basile | 5/180 |
| 1,381,136 | 6/1921 | Ribeiro | 297/45 |
| 2,590,129 | 3/1952 | Sawaya | 5/176 R |
| 2,780,506 | 2/1957 | Howe | 108/113 |
| 3,136,272 | 6/1964 | Sprigman | 297/45 X |
| 3,144,841 | 8/1964 | Meringoff | 108/113 |
| 4,030,769 | 6/1977 | Peng et al. | 297/45 |

FOREIGN PATENT DOCUMENTS

| | | | |
|---|---|---|---|
| 381607 | 11/1907 | France | 5/154 |

*Primary Examiner*—Francis K. Zugel
*Attorney, Agent, or Firm*—Fleit & Jacobson

[57] ABSTRACT

An improved collapsible support structure having, in an erect position, a pair of vertical members interconnected by at least one collapsible or foldable support mechanism. The collapsible support mechanism has upper and lower substantially horizontal collapsible connecting members that are interconnected by diagonal support members forming an "X" positioned approximately halfway between the pair of vertical members. Each of the horizontal members is formed of a plurality of pivotally interconnected elements and at least one of the elements of one of the members is modified to maintain a desired angular relationship between the elements. A plurality of the collapsible support structures are combined together or interconnected to form improved collapsible or folding devices.

8 Claims, 17 Drawing Figures

210
214
214
232
232
254
254
248
244
244
240
240
248
242
242
224
248
230
230
218
216
254
212
212

310
314
13
17
332
344
332
344
330
330
342
342
11
51
15
312

COLLAPSIBLE SUPPORT STRUCTURE AND DEVICES FORMED THEREFROM

BACKGROUND OF THE INVENTION

1. Field of the Invention

This invention relates to collapsible support structures. More specifically, the present invention relates to support structures that are collapsible to reduce their width. A plurality of such support structures are combined or interconnected to form folding structures, such as chairs, shopping carts, and trailer covers.

2. Description of the Prior Art

Numerous types of collapsible structures are known to the prior art. For instance, U.S. Pat. No. 430,703 describes a portable chair having members interconnected by hinges. U.S. Pat. No. 2,766,813 describes a collapsible chair having vertical members interconnected by cross-diagonal members. U.S. Pat. Nos. 3,736,021 and 3,968,991 describe collapsible or folding wheelchairs.

Representative problems encountered with use of previously known foldable support structures include the need to use an excessive number of component parts, a limitation on the amount of size reduction obtainable with the collapsible structures, difficulty in moving the structures between collapsed and supporting positions, and a lack of rigidity when the structures are in supporting positions.

SUMMARY OF THE INVENTION

Accordingly, it is an object of the present invention to provide an improved collapsible support structure that minimizes or eliminates problems encountered with previously known collapsible support structures.

It is a further object of the present invention to provide an improved collapsible support structure that requires a minimum number of component pieces.

A still further object of the present invention is to provide a collapsible support structure of improved construction that is adapted to be folded in extremely compact form, and that is strong and efficient in use.

Still another object of the present invention is to provide a folding chair that can be readily collapsed or folded for carrying purposes, and can be easily opened up when required for use.

In accordance with the present invention, an improved collapsible support structure is provided that has two vertical members interconnected by at least one collapsible or foldable support mechanism in such manner that the vertical members are adjacent to each other in a collapsed or folded position, and are spaced from each other in an erected or supporting position.

The collapsible or foldable support mechanism includes upper and lower foldable or collapsible connecting members, each connecting member having a first link or component member pivotally connected at one end to one of the vertical members, and a second link or component member pivotally connected at one end to the other of the vertical members. The first and second component members have end portions that overlap each other, and are pivotally interconnected. Preferably, at least one of the component members of either or both the upper and lower connecting members is modified to maintain the component members in a desired angular relationship with each other when the support structure is erected. For instance, one of the component members, in the region of overlap of the component members, includes a protruding tabular portion adapted to engage with a recessed portion formed in the end of the other component member. The tabular portion, when engaged with the other component member, prevents further angular movement in a downward direction of the component members with respect to each other, thereby maintaining a desired angular relationship, preferably such that the upper central portion of the foldable support mechanism is located on or just underneath a line extending from the connecting point of the first upper link and one of the vertical members and the connecting point of the second upper link and the other vertical member.

The collapsible support mechanism also includes diagonal support members for interconnecting the upper and lower connecting members. One of the diagonal support members connects the first component member of the upper connecting member with the second component member of the lower connecting member, while the other diagonal support member interconnects the second component member of the upper connecting member with the first component member of the lower connecting member. The diagonal support members are positioned so that they do not interfere with the folding of the support mechanism, for example, on opposite sides of the component members.

In order to avoid interference between the different members of the support structure when the support mechanism is collapsed, a variable number of spacers or washers are provided at one or more of the various points of interconnection of the members. The number and/or size of the spacers provided is determined by the width and number of component members that are positioned between the members connected by a particular point of connection when the structure is collapsed.

A collapsible structure, such as a folding chair, is formed by interconnecting four of the improved collapsible support structures of the present invention. The front of such a folding chair is formed of a front pair of vertical members interconnected by a support mechanism of the present invention having an erected height which is equal or less than the height of the front pair of vertical members. Preferably, the erected height of the support mechanism is less than the height of the vertical members. The back of the chair is formed by a back pair of vertical members having a height greater than the front pair of vertical members. The back pair of vertical members are interconnected by a support structure of the present invention having an erected height greater than the erected height of the foldable support mechanism interconnecting the front pair of vertical members. The sides of the chair are formed by support structures of the present invention which share common vertical members and thus interconnect front and back support structures to form, in top view, a parallelogram. The erected height of the collapsible support mechanisms forming the sides is preferably intermediate the height of the collapsible support mechanisms forming the front and back of the chair. All of the vertical members are appropriately modified to facilitate fastening of a seat material, such as canvas, to the folding chair.

In collapsible support structures other than folding chairs, it is obvious that the relative height of the different collapsible support mechanisms may be varied in accordance with the desires of the user of the invention.

The invention and its objects and advantages will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Because collapsible support structures are well known, the present description will be directed in particular to elements forming part of, or cooperating more directly with, the present invention. Elements not specifically shown or described herein are understood to be selectable from those known in the art.

Figure 1:
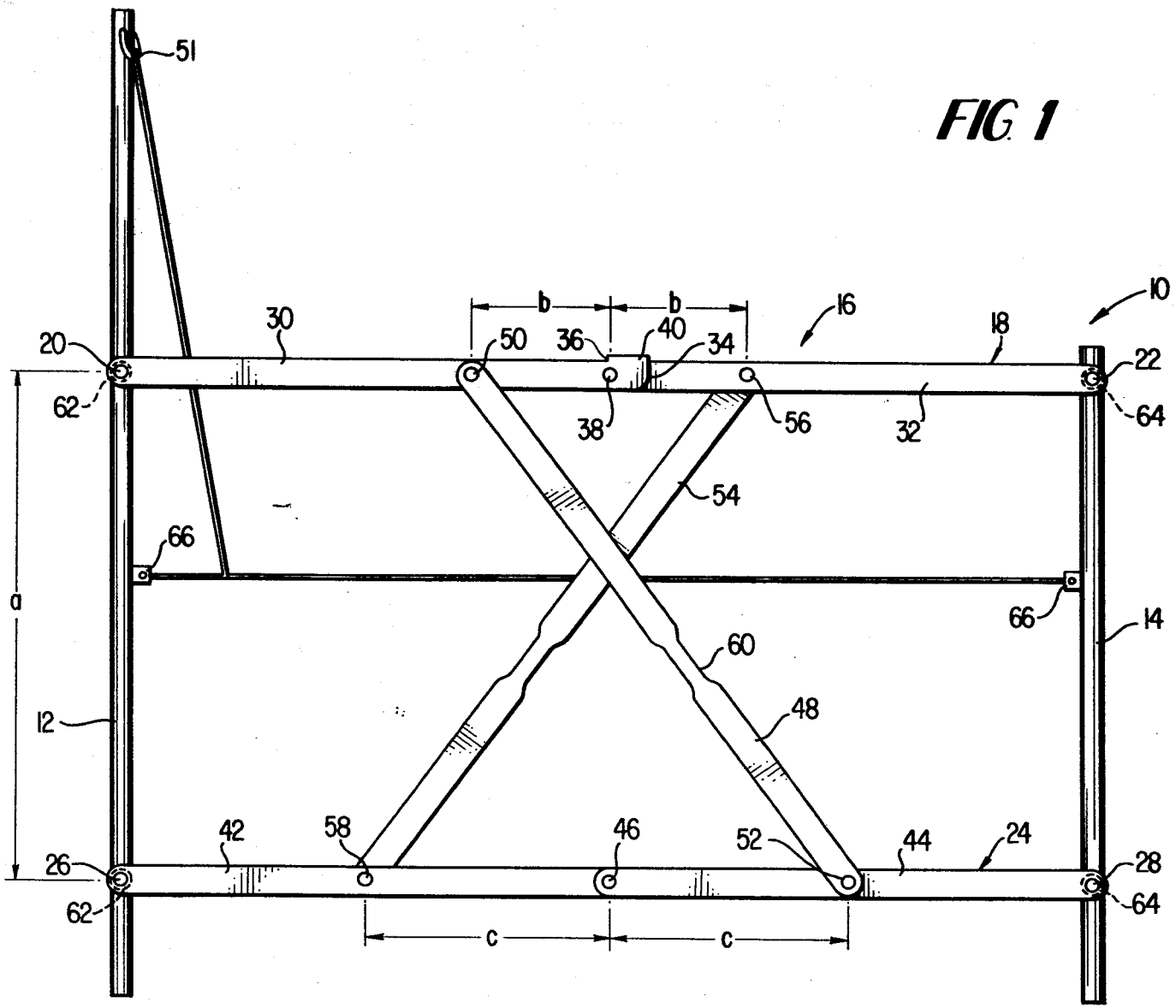
FIG. 1 is a front elevation of one embodiment of a collapsible support structure of the present invention in an erected position.

Referring now to the drawings wherein the same reference numerals are used to identify similar components in the different figures, and referring to FIG. 1 in particular, a collapsible support structure according to the present invention, which is generally designated 10, is illustrated. The structure 10, in an erect or supporting position, has a pair of vertical members or potst 12 and 14 connected to each other by a collapsible support mechanism, which is generally designated 16.

Figure 2:
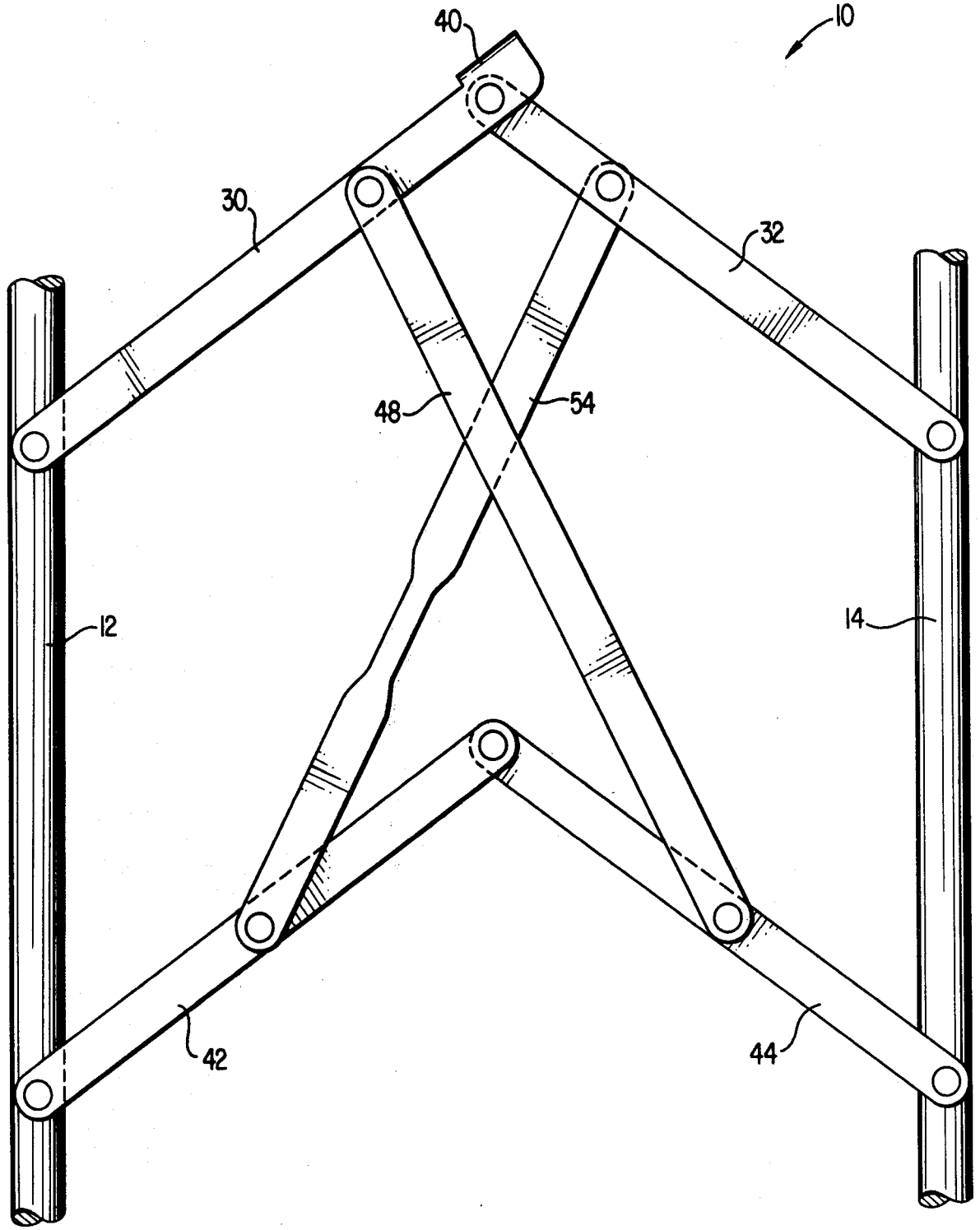
FIG. 2 is a front elevation of the structure of FIG. 1 in a partially erected, or partially collapsed, position.

The mechanism 16 has an upper foldable connecting member, generally designated 18, pivotally connected at 20 to the vertical member 12 and pivotally connected at 22 to the vertical member 14. A lower foldable connecting member, generally designated 24, is pivotally connected at 26 and 28 to the vertical members 12 and 14, respectively. The upper member 18 is comprised of a plurality of pivotally interconnected links or component members, two of which, designated 30 and 32, are illustrated. The links have distal ends connected to the vertical members, and proximal ends 34 and 36, respectively, overlapping each other and connected by a pivotal connection 38. As illustrated in FIG. 2, the interconnected members 30 and 32 form a knee joint that is adapted to fold upwardly during the movement of the support structure 10 from an erected to a collapsed position. Also, as illustrated in FIG. 1, the end of one of the links 30, 32, for instance, end 34 includes a protruding tabular portion or shoulder lock 40 that is adapted to engage with the end of the other component member to limit the downward swing or movement of the members 30, 32, thereby preventing collapse of vertical members 12 and 14 towards each other. Preferably, the portion of the end 36 engaged by lock 40 is cut-away or recessed to receive the lock.

The lower foldable connecting member 24 is formed of a plurality of links or component members, two of which, designated 42 and 44, are illustrated. The links 42, 44 have distal ends connected to the vertical members 12 and 14 and proximal ends overlapping and interconnected to each other by a pivotal connection 46. Preferably, the pivotal connections 38 and 46 are located substantially halfway between the vertical members 12 and 14 when the structure 10 is in an erect position.

The upper and lower foldable connecting members 18 and 24 are interconnected by diagonal support members or cross bars that form an "X" when the support structure is in a fully opened or erect position. A first of the diagonal support members, which is designated 48, is pivotally connected at 50 to the first link 30 of the upper connecting member and is pivotally connected at 52 to link 44 of the lower connecting member. Similarly, a second diagonal support member 54 extends between a connection point 56 on member 32 and a connection point 58 on member or link 42.

The cross bars 48 and 54, when in fully opened position, provide parallelism between the upper and lower sets of horizontal links, thereby preventing collapse of the vertical members 12, 14. Also, use of the cross bars provides a strong and safe support mechanism.

Referring now to FIG. 1, an important relationship between the cross bars 48 and 54 and upper and lower connecting members 18 and 24 will be described in more detail. When the support structure is in an erect position, there is a vertical distance between the pivotal connection 20 and the pivotal connection 26 which equals the vertical distance between pivotal connection 22 and pivotal connection 28. This distance is designated "a" in FIG. 1. Also, there is a horizontal distance between pivotal connection 50 and pivotal connection 38 which equals the horizontal distance between pivotal connection 38 and pivotal connection 56. These distances are designated "b" in FIG. 1. Further, there is a horizontal distance between pivotal connection 58 and pivotal connection 46 which equals the horizontal distance between connection 46 and pivotal connection 52. These distances are designated "c" in FIG. 1. Preferably, the above mentioned distances conform to Formula A, which is as follows:

$$(1/b)-(1/c)=2/a \qquad \text{(Formula A)}$$

Because of different factors, like play at the different pivotal connections of the vertical, horizontal and cross members, etc., structures may be made which do not conform perfectly with Formula A and still operate satisfactorily and the present invention is intended to cover such structures.

It will be appreciated that movement of the support structure from an erect to a collapsed position, or vice versa, requires movement on four different levels. Support members 54 moves on an inner or first level. Links 32 and 42 move on an intermediate or second level. Links 30 and 44 move on another intermediate or third level. Support member 48 moves in an outer or fourth level. Since the members are not necessarily planar, the surfaces formed by the movement of the members might or might not be planar. In order to minimize the possible interference between the various component members of the support structure 10, numerous modifications have been made to the component members. For instance, a recess 60 is provided on both sides of a lower portion of the cross bar 48 to provide clearance between the cross bar and the connection 20 on vertical member 12 and the connection 22 on vertical member 14. Also, spacers or washers 62 having a width equal to the thickness of the diagonal support members 48, 54 are incorporated in the pivotal connections 20 and 26. In a similar manner, spacers 64, which are either a single spacer or a plurality of spacers equal to the combined width of the diagonal support members 48, 54, are associated with the pivotal connections 22, 28 attached to vertical member 14. Other possible modifications include tapering selected portions of the components instead of or in addition to providing recesses and bending selected portions of the component members to provide the clearance required between the various levels. It will be appreciated that numerous combinations of the preceding can be used to provide the required clearance.

Figure 5:
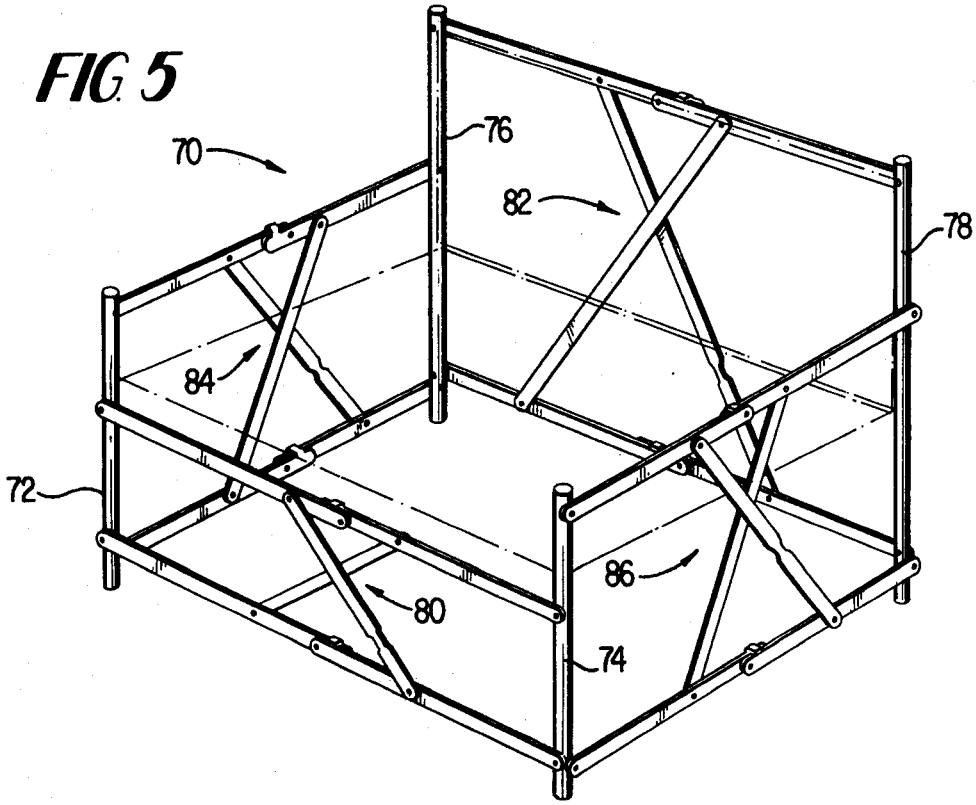
FIG. 5 is a perspective view of one embodiment of a folding chair using the collapsible support structure of FIG. 1.
Figure 6:
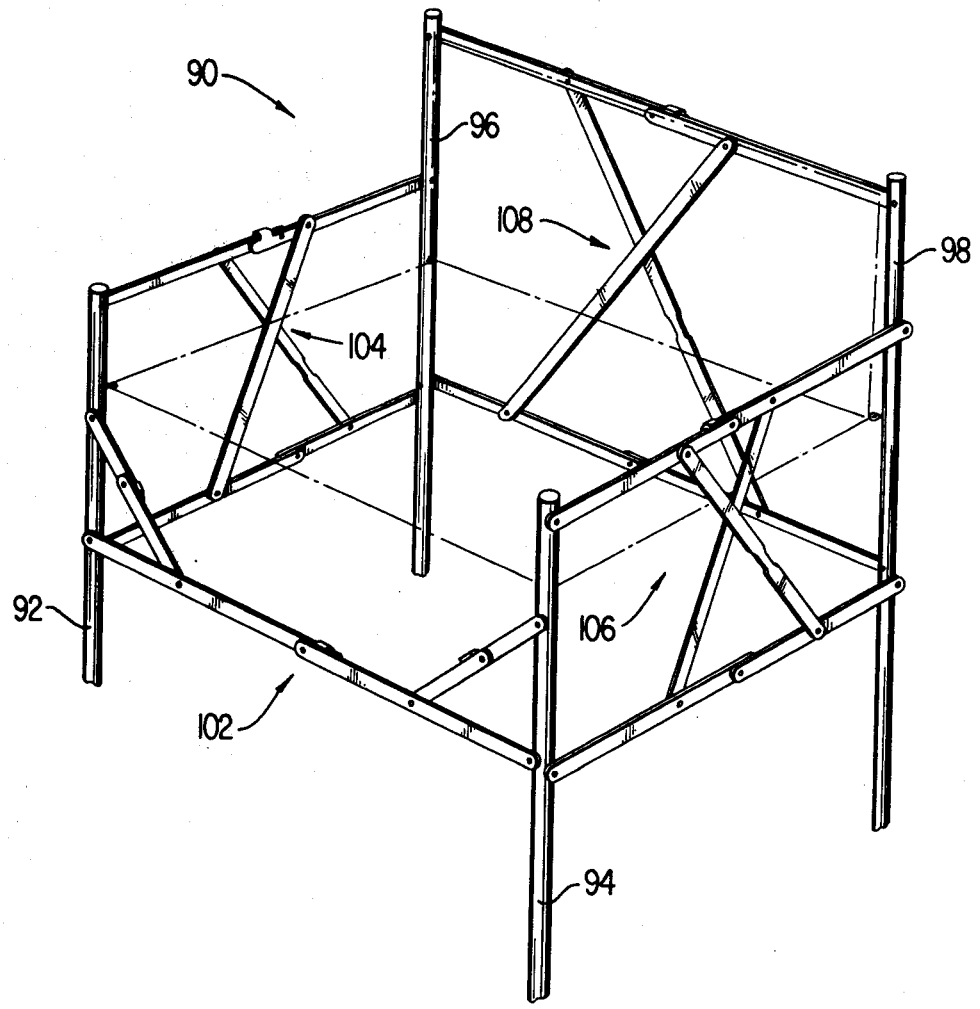
FIG. 6 is a perspective view of another embodiment of a folding chair using the collapsible support structure of FIG. 1.

The vertical supports 12 and 14 are provided with a plurality of devices adapted to connect material, such as canvas, netting, or plastic sheet material, as illustrated by phantom lines in FIGS. 5 and 6, to the posts. FIG. 1 illustrates projecting support pins 66; however, it will be appreciated that holes drilled in the posts 12, 14, indentations formed in the posts, hooks attached to the posts and other suitable methods can be used to attach material to the posts.

Figure 3:
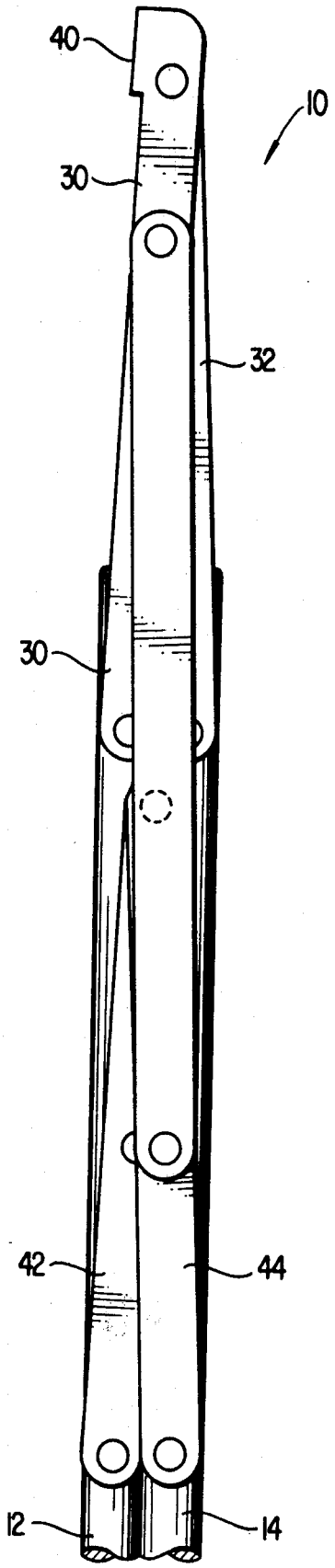
FIG. 3 is a front elevation of the structure of FIG. 1 in a collapsed position.
Figure 4:
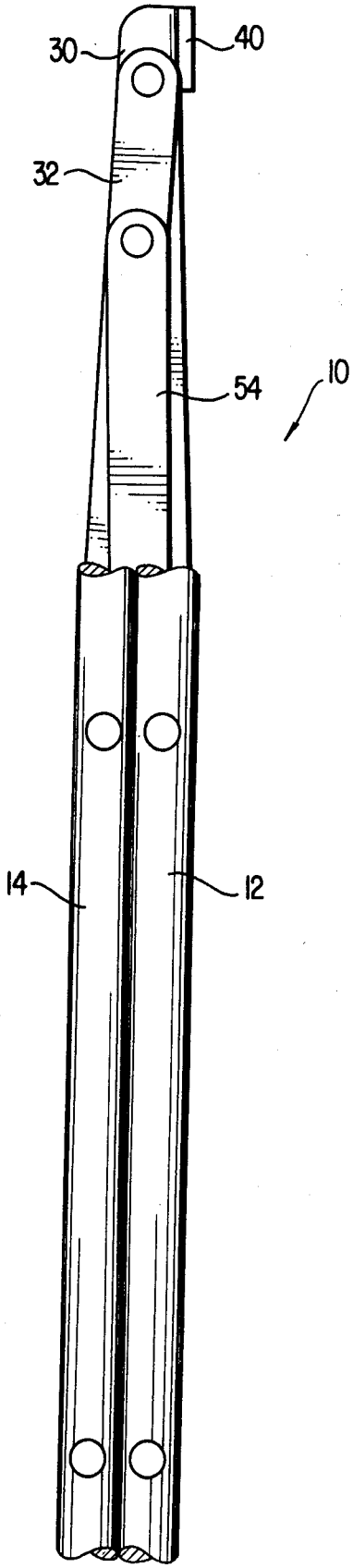
FIG. 4 is a rear elevation of the structure of FIG. 1 in a collapsed position.

In order to move the support structure 10 from the position illustrated in FIG. 1 to that illustrated in FIGS. 3 and 4, the end 34 of the link 30 containing the tabular portion 40 is grasped and pulled in an upward manner. A ring (not shown) adapted to be grasped by a user may be attached to link 30 to facilitate its upward movement. This upward movement folds upwardly the knee joint formed between the links 30 and 32. Also, because the links 30 and 32 are interconnected to the links 42 and 44 by the cross members 48 and 54, the knee joint formed in the lower connecting member is also folded upwardly. This upward folding of the knee joints moves the vertical members 12 and 14 towards each other. FIG. 2 illustrates an intermediate position of the support structure 10 during its collapse. Continued upward movement of the knee joints formed between the members of the upper and lower connecting members continues the movement of the vertical members 12, 14 towards each other. Finally, the support structure is collapsed into the position illustrated in FIGS. 3 and 4.

In order to erect the support structure 10, the procedure used to collapse the structure is reversed. Thus, FIG. 2 illustrates both a partially erected and a partially collapsed position of the support structure.

Figure 7:
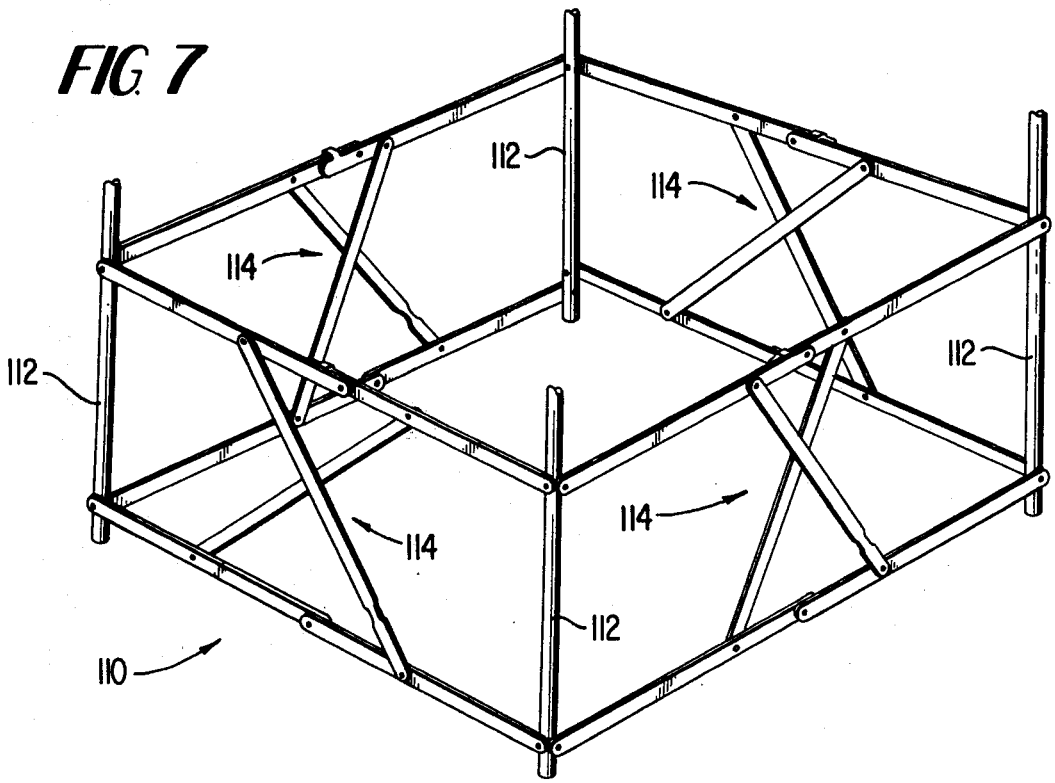
FIG. 7 is a perspective view of an embodiment of a device using the collapsible support structure of FIG. 1.

Referring now to FIGS. 5 to 7, devices utilizing the support structure of FIGS. 1 to 4 are illustrated.

FIG. 5 illustrates a folding chair, generally designated 70, formed of four interconnected support structures of the type illustrated in FIGS. 1 to 4. In an erect position, the chair 70 has a pair of vertical members 72, 74 defining front corners or edges of the chair and a pair of vertical members 76, 78 defining rear corners or edges of the chair. As can be seen in FIG. 5, the pair of members 76, 78 have a greater length than the pair of members 72, 74, so that the back of the chair is higher than the front. The members 72, 74 are interconnected by a collapsible support mechanism 80, while the rear vertical members 76, 78 are interconnected by a collapsible support mechanism 82. Collapsible support mechanisms 84 and 86 interconnect vertical members 72, 76 and 74, 78 respectively. Since the support mechanisms 80, 82, 84 and 86 are basically the same as the previously discussed collapsible support mechanism 16, detailed comments on the construction and operation of these support mechanisms are not considered necessary.

In operation, the folding chair 70 is moved from an erect to a collapsed position by collapsing opposed pairs of the support mechanisms. For instance, support mechanisms 84 and 86 are collapsed to move the posts 72 and 76 and the posts 74 and 78, respectively, towards each other. Then, the support mechanisms 80 and 82 are collapsed to move the posts 72 and 74 and the posts 76 and 78, respectively, towards each other. The chair 70, in a collapsed position, forms a compact, easily transportable package.

Numerous modifications of the structure illustrated in FIG. 5 are possible. For instance, in one modification, the posts 76 and 78 are formed of telescoping members that are extendable in an upward direction to increase the height of the back of the chair. Alternatively, the back of the chain is formed of a plurality of vertically aligned support mechanisms similar to support mechanism 82. In another modification, bottoms of the posts 72, 74, 76 and 78 are formed with telescoping members that extend in a downward direction to increase the erected height of the chair.

Referring now to FIG. 6, a folding chair, which is generally designated 90, is illustrated. The chair 90, in an erect position, includes a pair of front vertical posts 92, 94 and a pair of rear vertical posts 96, 98. The front posts 92, 94 are interconnected by a collapsible support mechanism 102 of a previously known type. The vertical members 92, 96 and the vertical members 94, 98 are interconnected by support mechanisms 104, 106, respectively. Finally, the vertical members 96, 98 are interconnected by a support mechanism 108. The support mechanisms 104, 106 and 108 are similar to the support mechanism previously described in connection with FIGS. 1 to 4. Also, the folding chair 90 is collapsed in a manner similar to the collapsing of the folding chair 70.

Referring now to FIG. 7, a collapsible support device, generally designated 110, is illustrated. The device 10, in an erect or supporting position, has four vertical posts 112 interconnected by four support mechanisms 114. The support mechanisms 114 are similar to the mechanism 16 illustrated in FIGS. 1 and 4.

The support device 110 has numerous possible uses. For instance, a collapsible covering for a trailer, a swimming pool, or a garage is formed by attaching canvas or other suitable material to outer surfaces and over the tops of the posts 112. A collapsible transport device for use underwater is formed by attaching netting to interior portions and across bottom portions of the posts 112. A portable collapsible carriage is formed by attaching wheels to the bottoms of the posts 112. A collapsible sled is formed by attaching runners to the bottoms of posts 112. These and other uses of the support device 112 will be readily apparent to those skilled in the art.

The embodiments of the present invention described in connection with FIGS. 1–7 have used a collapsibe support mechanism having diagonal support members or cross bars positioned on opposite surfaces of the connecting members. For instance, referring to FIG. 1, the support member 48 is connected to outer surfaces (surfaces facing towards an observer) of connecting members 18 and 24. Further, support member 54 is connected to inner surfaces (surfaces facing away from an observer) of connecting members 18 and 14. Also, the links 30 and 44, the links to which support member 48 is connected, are positioned on the outside of links 32 and 42, the links to which the support member 54 is connected. With the component members of the support mechanism arranged in this fashion, a minimum number of modifications of the component members are required in order to provide clearance between the component members when the support mechanism is collapsed.

It will be readily appreciated that other arrangements of the component members of the collapsible support mechanism are possible within the spirit and scope of the present invention. For instance, referring now to FIG. 8, an embodiment of the present invention is illustrated in which the component members are arranged in a different manner. With this embodiment, the same reference numerals, preceded by the numeral "2", have been used to identify components similar to those previously discussed.

Figure 8:
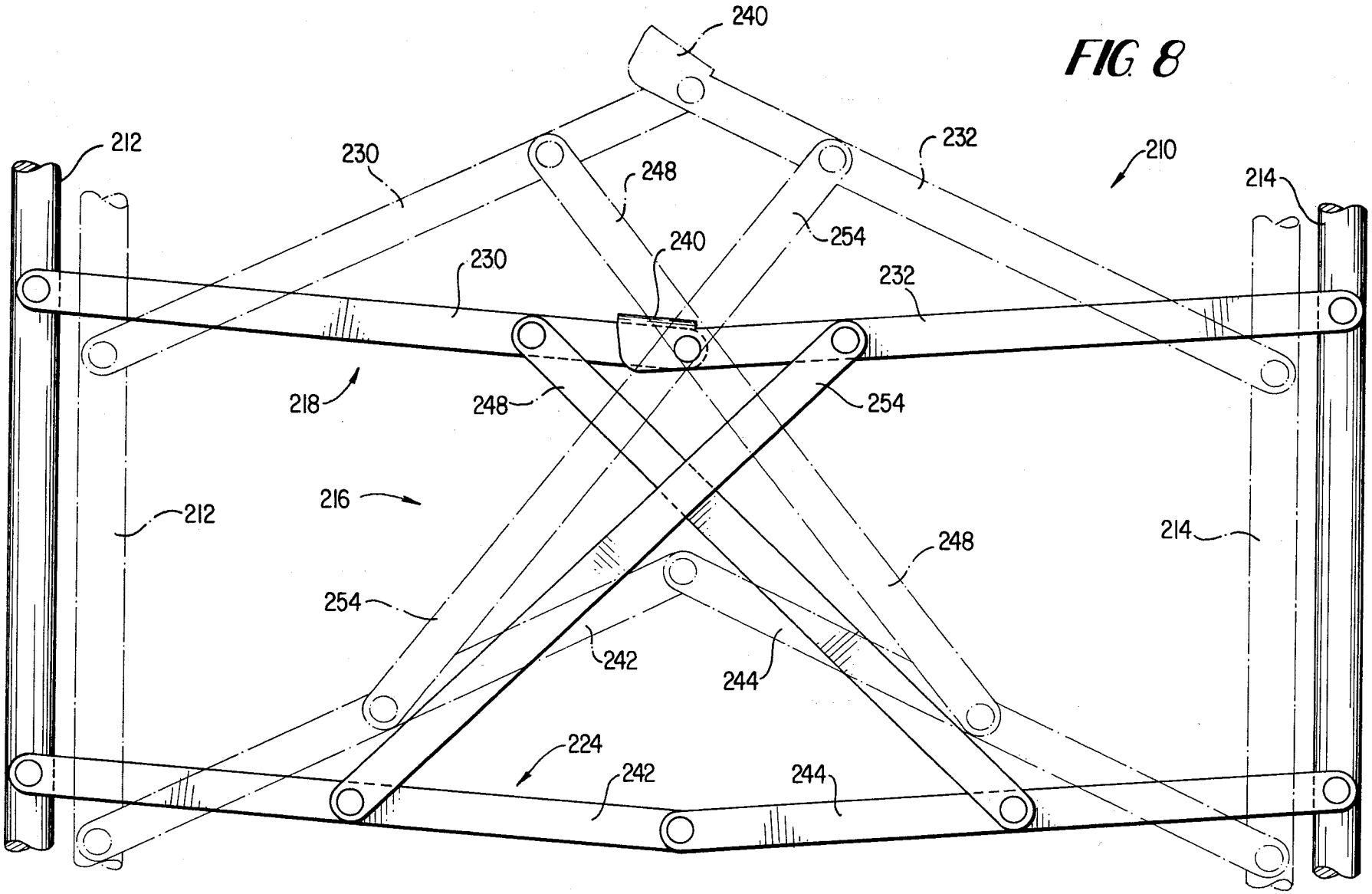
FIG. 8 is a front elevation of another embodiment of the collapsible support structure of the present invention, in an erected position.

As illustrated in FIG. 8, a collapsible support structure, generally designated 210, is comprised of a pair of vertical members 212, 214 interconnected by a collapsible support mechanism, generally designated 216. The collapsible support mechanism 216 has an upper foldable connecting member 218 and a lower foldable connecting member 224 interconnected by diagonal support members or cross bars 248 and 254 which form an "X" shape when the support structure is in an erected position. The upper connecting member 218 is formed of pivotally connected links or component members 230 and 232, while the lower connecting member 224 is formed of pivotally interconnected links 242 and 244. The support members 248 and 254 are positioned on outer surfaces (surfaces facing an observer of FIG. 8) of the links 230, 232, 242 and 244. Also, outer surfaces of the links 232 and 244 overlap and cover outer surfaces of the links 230 and 242, respectively. Positioning of the support members 248 and 254 on the outside of connecting members 218 and 224 reduces the amount of clearance that must be provided between the ends of the connecting members 218,, 224 and the vertical members 212, 214.

Movement of the structure illustrated in FIG. 8 between a collapsed and an erected position and between an erected and a collapsed position is accomplished in a manner similar to that previously discussed in connection with FIGS. 1–4. Accordingly, a detailed description is not considered necessary. Also, it will be appreciated that the structure illustrated in FIG. 8 can be used in connection with or in place of the structure illustrated in FIGS. 1–4 to form the structures illustrated in FIGS. 5–7.

Figure 9:
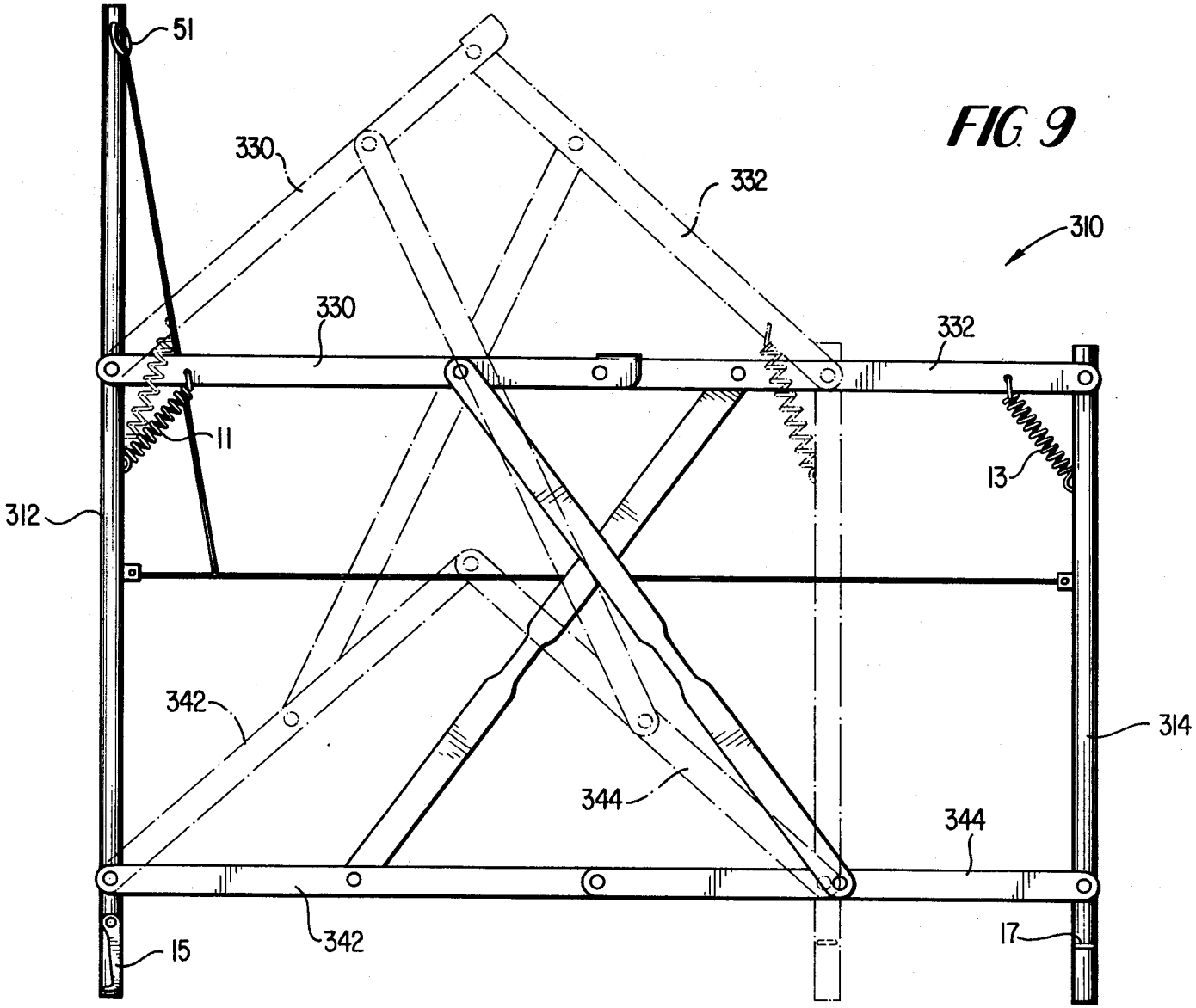
FIG. 9 is a front elevation of still another embodiment of the collapsible support structure of the present invention, in an erected position.

Referring now to FIG. 9, a modified embodiment of the support structure of FIG. 1 is illustrated. With this embodiment, the same reference numerals, preceded by the numeral "3", have been used to identify components similar to those previously discussed. The support structure, which is generally designated 310, is the support structure 10, modified to include springs 11 and 13. Spring 11 is interconnected between link 330 and vertical member 312, while spring 13 is interconnected between link 332 and vertical member 314. The springs are provided to assist movement of the support structure 310 from a collapsed to an erected position. A locking mechanism, for instance a pivotally mounted hook 15 on vertical member 312 which is engagable with an eye 17 on vertical member 314, is provided to hold the support structure 310 in a collapsed position. When the locking mechanism is released, the support structure automatically moves to the erected position.

Figure 12:
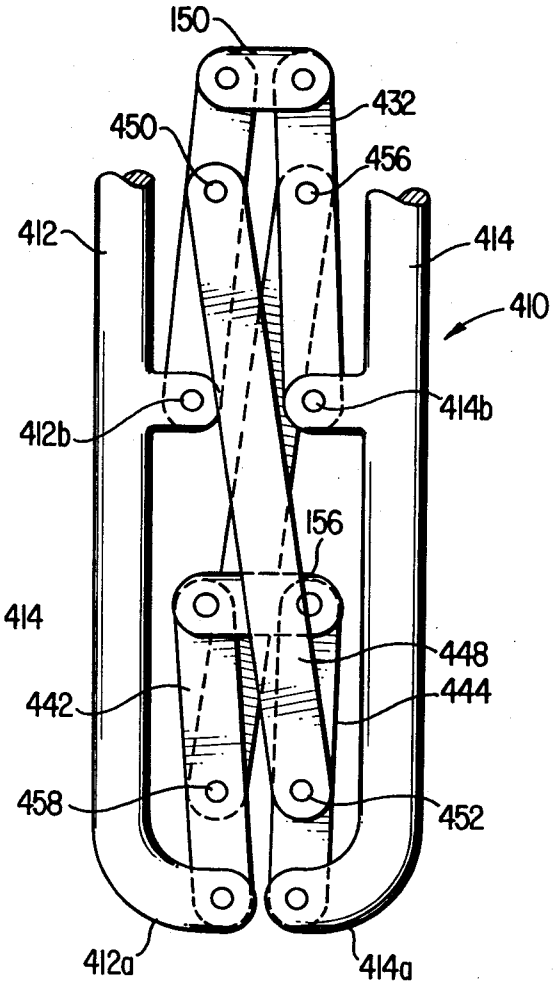
FIG. 12 is a front elevation of the structure of FIG. 10 in a collapsed position.
Figure 10:
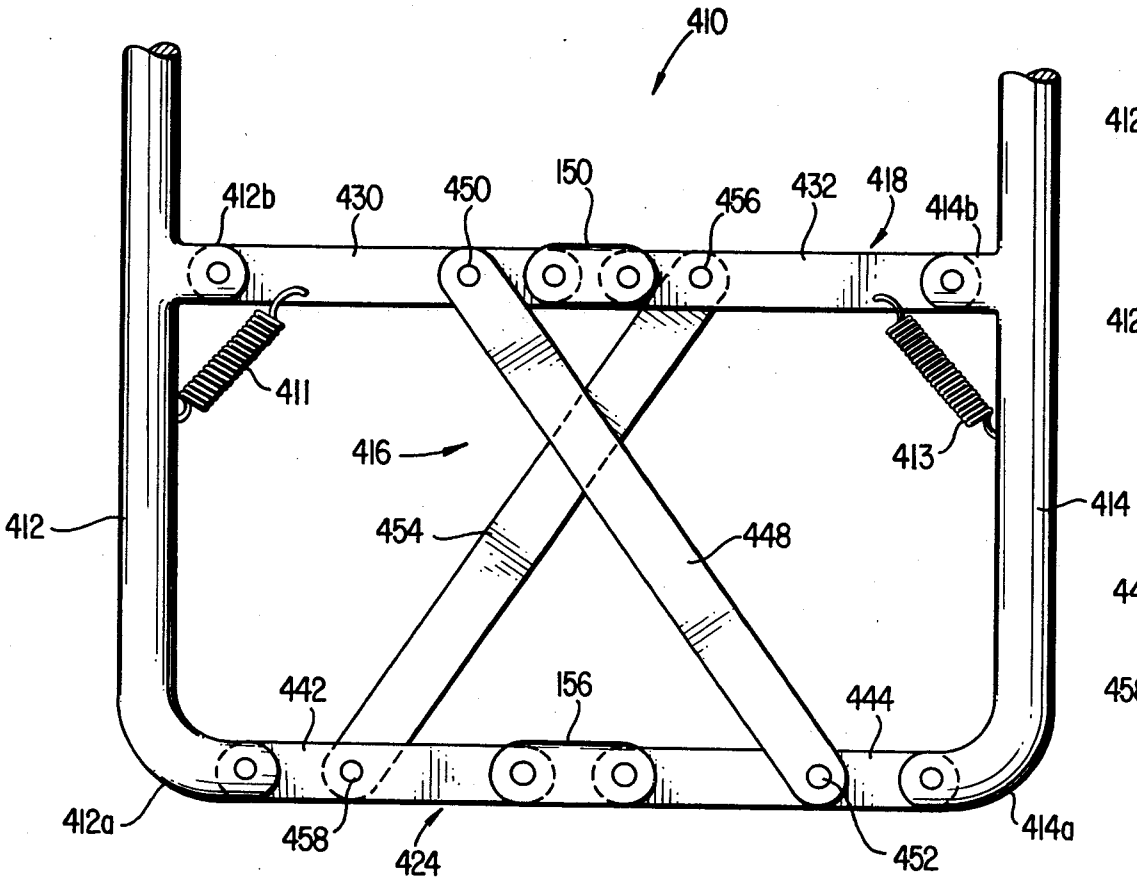
FIG. 10 is a front elevation similar to FIG. 1 of another embodiment of a collapsible support structure of the present invention, in an erected position.
Figure 11:
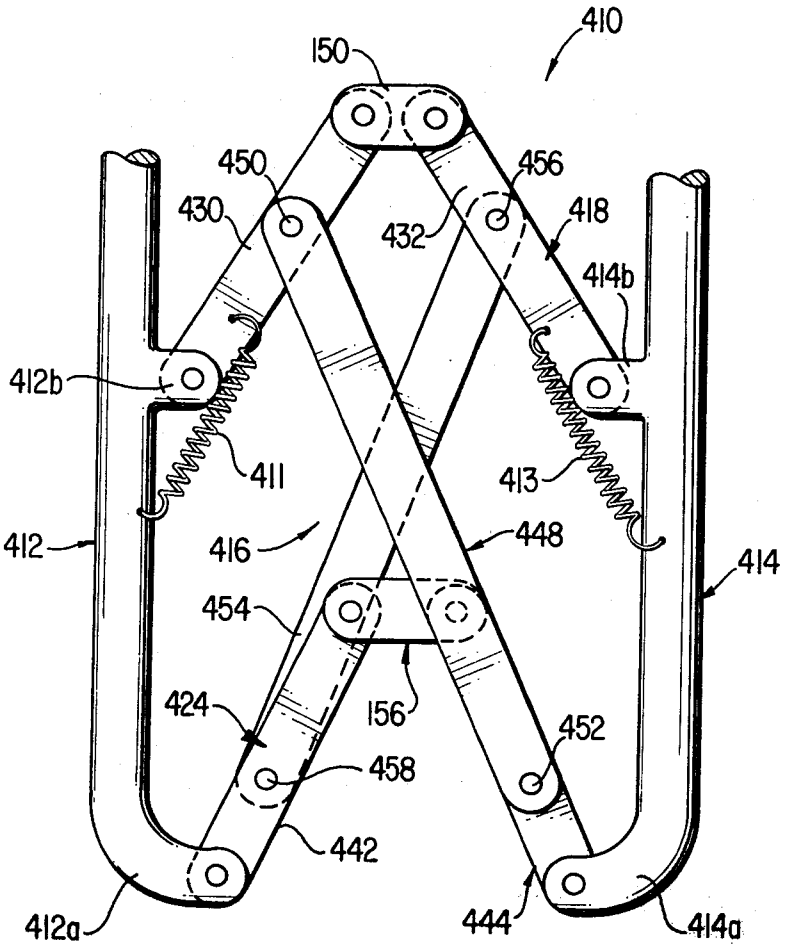
FIG. 11 is a front elevation of the structure of FIG. 10 in a partially erected, or partially collapsed, position.

Referring now to FIGS. 10 to 12, another embodiment of the support structure of the present invention is illustrated. With this embodiment, the same reference numerals, preceded by the numeral "4", have been used to identify components similar to those previously discussed. The support structure, which is generally designated 410, has two vertical members, 412 and 414, interconnected by a collapsible or foldable support mechanism, which is generally designated 416. Member 412 has an arcuate-shaped end 412*a* and a protrusion 412*b* formed intermediate its ends. Similarly, member 414 has an arcuate-shaped end 414*a* and a protrusion or protruding portion 414*b*.

The mechanism 416 has an upper foldable connecting member, generally designated 418, pivotably interconnected between protrusions 412*b* and 414*b*. A lower foldable connecting member, generally designated 424, pivotably interconnects ends 412*a* and 414*a* with their arcuate-shaped portions facing each other.

The upper member 418 has links 430 and 432 with distal ends connected to the protrusions 412*b* and 414*b*, respectively, and proximal ends pivotally connected to a coupling member or plate 150. As can be seen from the drawings, the width of the coupling plate 150 is substantially the same as the width of the members 430 and 432. A spring 411 is positioned between members 412 and 430, and a spring 413 is positioned between members 414 and 432. The springs 411 and 413 urge the components of connecting member 418 into an erect or supporting position.

The lower foldable connecting member 424 has two links or component members 442 and 444, with distal ends pivotally interconnected to the ends 412*a* and 414*a*, respectively. Proximal ends of the members 442 and 444 face each other and are interconnected by a coupling plate 156, which is similar to coupling plate 150.

The upper and lower foldable connecting members 418 and 424 are interconnected by diagonal support members or cross bars that form an "X" when the support structure is in a fully opened, erect supporting position. A first of the diagonal support members, which is designated 448, is pivotally connected at 450 to member 430 and is pivotally connected at 452 to member 444. Similarly, a second diagonal support member 454 extends between a connection point 456 on member 432 and a connection point 458 on member 442.

It will be appreciated that the procedure used to move the support structure 410 from the fully erect position illustrated in FIG. 10, through the partially collapsed position illustrated in FIG. 11, to the fully collapsed position illustrated in FIG. 12, or vice versa, is similar to the procedure used to move the embodiment illustrated in FIGS. 1 to 4 between the erected and collapsed positions.

Figure 13:
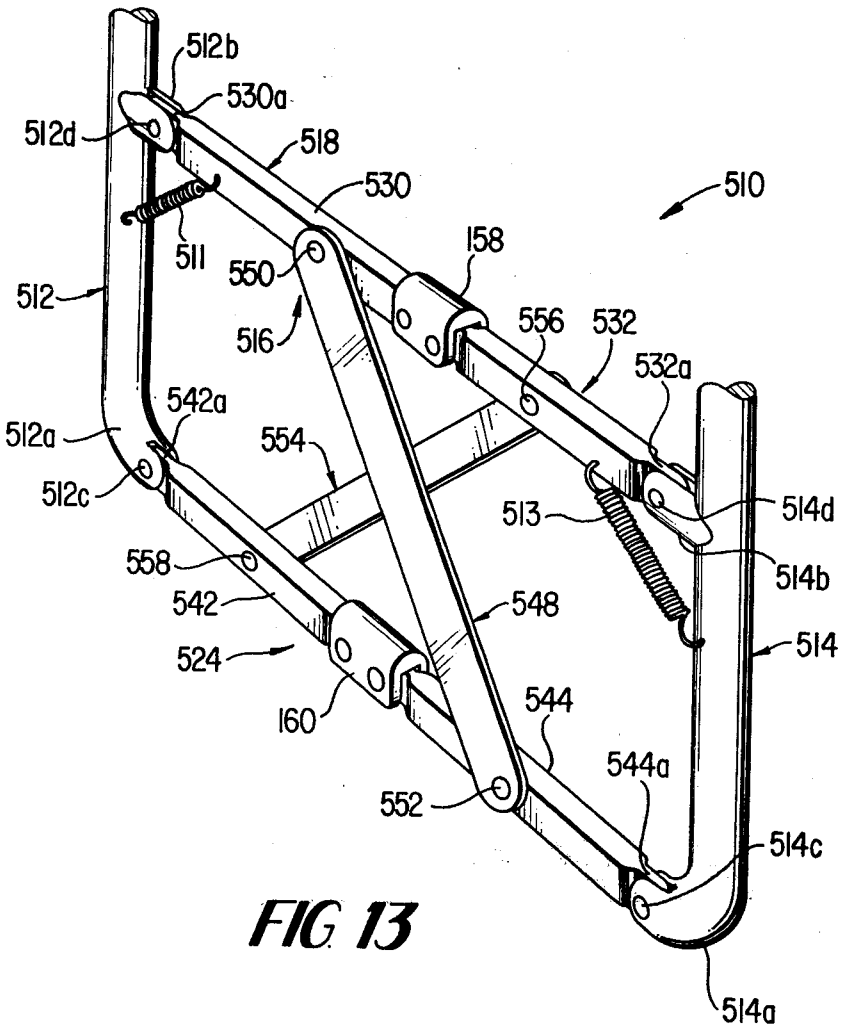
FIG. 13 is a perspective view of still another embodiment of a collapsible support structure of the present invention, in an erected position.
Figure 14:
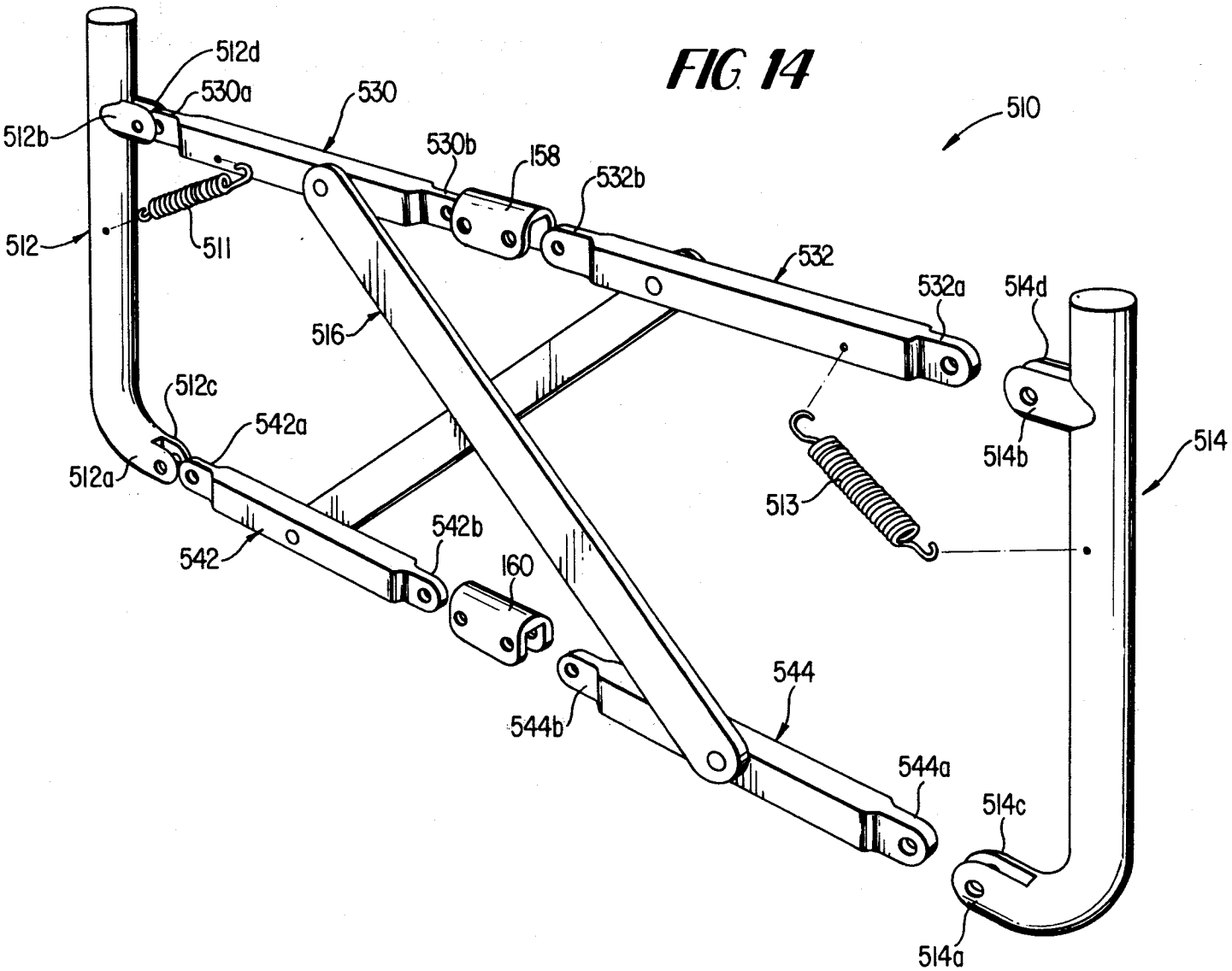
FIG. 14 is an exploded perspective view of the embodiment illustrated in FIG. 13.

Referring now to FIGS. 13 and 14, another embodiment of a support structure of the present invention is illustrated. Since this embodiment is similar to those previously discussed, the same reference numerals, preceded by the numerals "5", have been used to identify components similar to those previoulsy discussed.

As illustrated in FIGS. 13 and 14, a support structure, which is generally designated 510, has a pair of vertical members or posts 512 and 514 connected to each other by a collapsible support mechanism, which is generally designated 516. Member 512 has one end **512*a* arcuately shaped and bifurcated to form a generally U-shaped female holding member 512*c*. A similar U-shaped holding member 512*d* is formed in protruding portion 512*b* of member 512. In similar manner, member 514 has an arcuate shaped lower portion or end 514*a* that is bifurcated to form a U-shaped holding member 514*c* and a protruding portion 514*b* that is bifurcated to form a U-shaped holding member 514*d***. Preferably, the midpoints of the bases of the U-shaped holding members are positioned in a common plane.

Considering now the support mechanism 516, it has an upper foldable connecting member, generally designated 518, pivotally connected between holding members **512*d* and 514*d*, and a lower foldable connecting member, generally designated 524, pivotally interconnected between holding members 512*c* and 514*c*. The upper connecting member 518 has links or component members 530 and 532. A distal end 530*a* of link 530 is tapered to form a male member insertable into the U-shaped female holding member 512*b*. Both the members 512*b* and 530*a* include openings that are alignable to receive a locking pin or similar member for pivotally interconnecting the members. Similarly, proximal end 530*b* of link 530 is tapered or shaped to form a male member insertable into a generally U-shaped, longitudinally-extending coupling plate 158. Both the members 158 and 530*b* have openings or apertures formed therein that are alignable with each other to receive a pin or similar locking mechanism for pivotally interconnecting the two. Link 532 has a shape corresponding to the shape of link 530, i.e., the distal end 532*a* of the link is shaped to fit into and be pivotally connected to the holding member 514*d*, while the proximal end 532*b* is shaped to fit into and be pivotally connected to the U-shaped coupling plate 158. It will be appreciated that the coupling plate 158 limits relative angular movement between the links 530 and 532**.

The lower foldable connecting member 524 is formed of components similar to those discussed in connection with the upper foldable connecting member 518. Thus, link 542 has a distal end **542*a* shaped to fit into and be pivotally connected to the U-shaped holding member 512*c*, and a proximal end 542*b* tapered to fit into and be pivotally connected to a U-shaped coupling plate 160. A second link 544, which is similar to link 542, has a distal end 544*a* shaped to fit into and be pivotally connected to the U-shaped holding member 514*c* and a proximal end 544*b* shaped to fit into and be pivotally held by the coupling plate 160**.

The upper and lower foldable connecting members 518 and 524 are interconnected by diagonal support members or cross bars that form an "X" when the support structure is in a fully opened or erect supporting position. A first of the diagonal support members, which is designated 548, is pivotally connected at 550 to link 530 and is pivotally connected at 552 to link 544. Similarly, a second diagonal support member 554 extends between a connection point 556 on link 532 and a connection point 558 on link 542. Springs 511 and 513 are provided to urge the support mechanism 516 into an erect position. A suitable method for connecting the springs to the components of the support structure is illustrated in FIG. 14.

Figure 15:
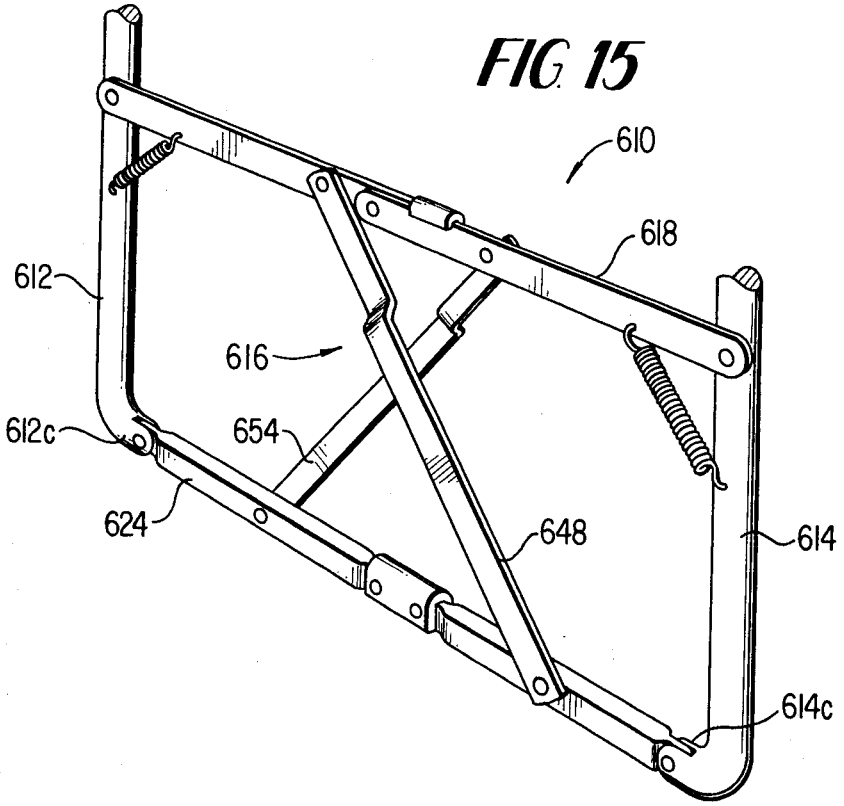
FIG. 15 is a perspective view of another embodiment of a collapsible support structure of the present invention, in an erected position.

Referring now to FIG. 15, still another embodiment of the collapsible support structure according to the present invention, which is generally designated 610, is illustrated. Since this embodiment is similar to those previously discussed, the same reference numerals, preceded by the numeral "6", have been used to identify components similar to those previously discussed.

The embodiment of FIG. 15 utilizes a collapsible support mechanism, which is generally designated 616, to interconnect posts or vertical members 612 and 614. The lower ends of the posts are arcuate shaped and define U-shaped holding members **612*c* and 614*c*, respectively, which are similar to the previously discussed members 512*c* and 514*c***. It will be appreciated that, in both this and the preceding embodiment, the lower portions of the vertical members can be tapered to form male members insertable into U-shaped female holding members formed at the distal ends of the links.

The support mechanism 616 includes an upper foldable connecting member, generally designated 618, of the type previously discussed in connection with the description of FIG. 9. Also, the mechanism 616 has a lower foldable connecting member, generally designated 624, of the type previously discussed in connection with FIGS. 13 and 14. As with the previously discussed embodiments, the upper and lower connecting members are interconnected by crossed diagonal supports 648 and 654.

Figure 16:
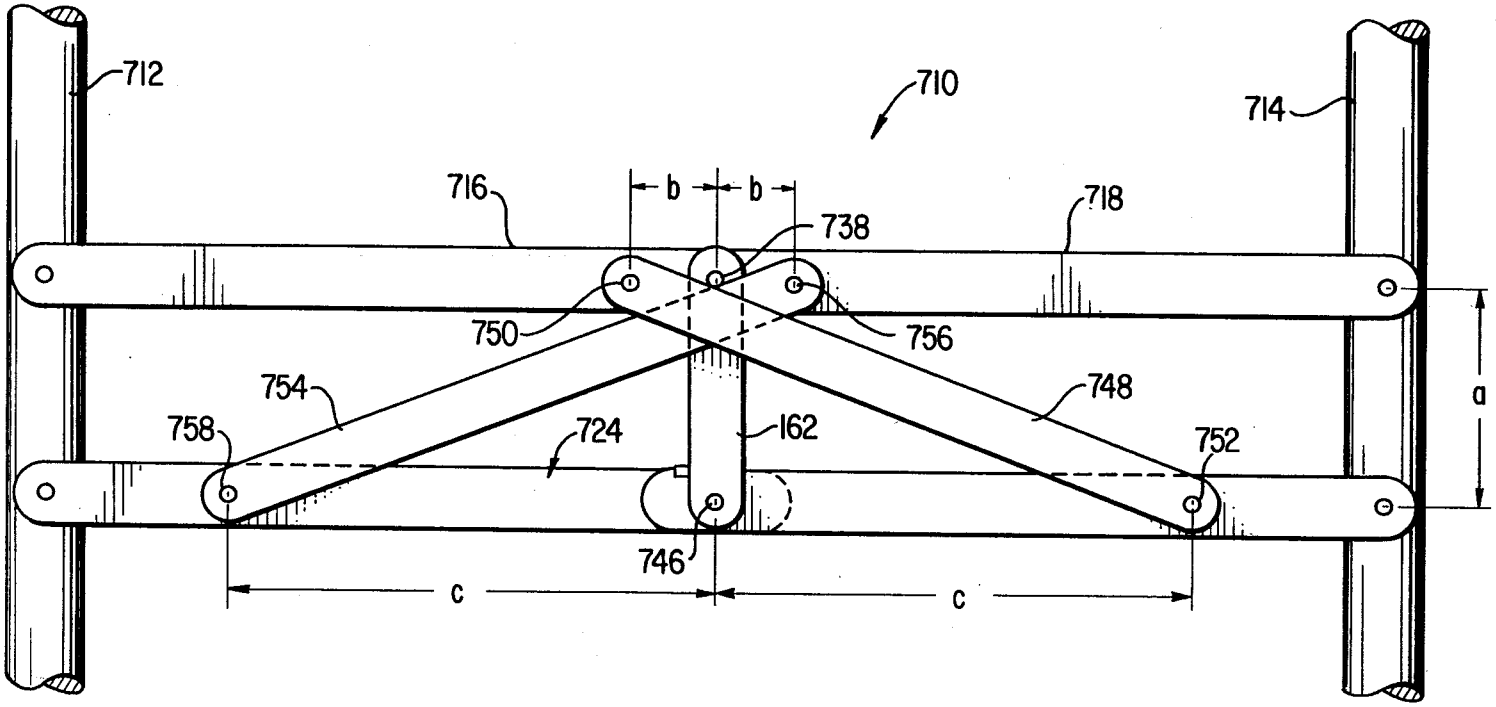
FIG. 16 is a front elevation similar to FIG. 1 of still another collapsible support structure of the present invention, in an erected position.

Considering now FIG. 16, another embodiment of a collapsible support structure according to the present invention, which is generally designated 710, is illustrated. With this embodiment, the same reference numerals, preceded by the numeral "7", have been used to identify components similar to those previously discussed.

The support structure 710 has members 712 and 714 pivotally interconnected by a collapsible support mechanism, which is generally designated 716. The mechanism 716 has an upper foldable connecting member, generally designated 718, and a lower foldable connecting member, generally designated 724, pivotally interconnected by crossed diagonal support members 748 and 754. As can be seen from FIG. 16, the distance "c" between connection points 746 and 758 or between connection points 746 and 752, is significantly greater than the distance "b" between connection points 738 and 750 or between connection points 738 and 756.

With this embodiment, an additional vertical member 162 has been positioned between the connection points 738 and 746 to hold the upper and lower horizontal members in a parallel relationship. Use of the member 162 is preferable but not required.

It will be appreciated that the collapsible support structures illustrated in FIGS. 10 to 16 can be combined with or used in place of the support structures illustrated in FIGS. 1, 8, and 9 to form collapsible structures and devices of the types illustrated in FIGS. 5, 6, 7, and 17.

Figure 17:
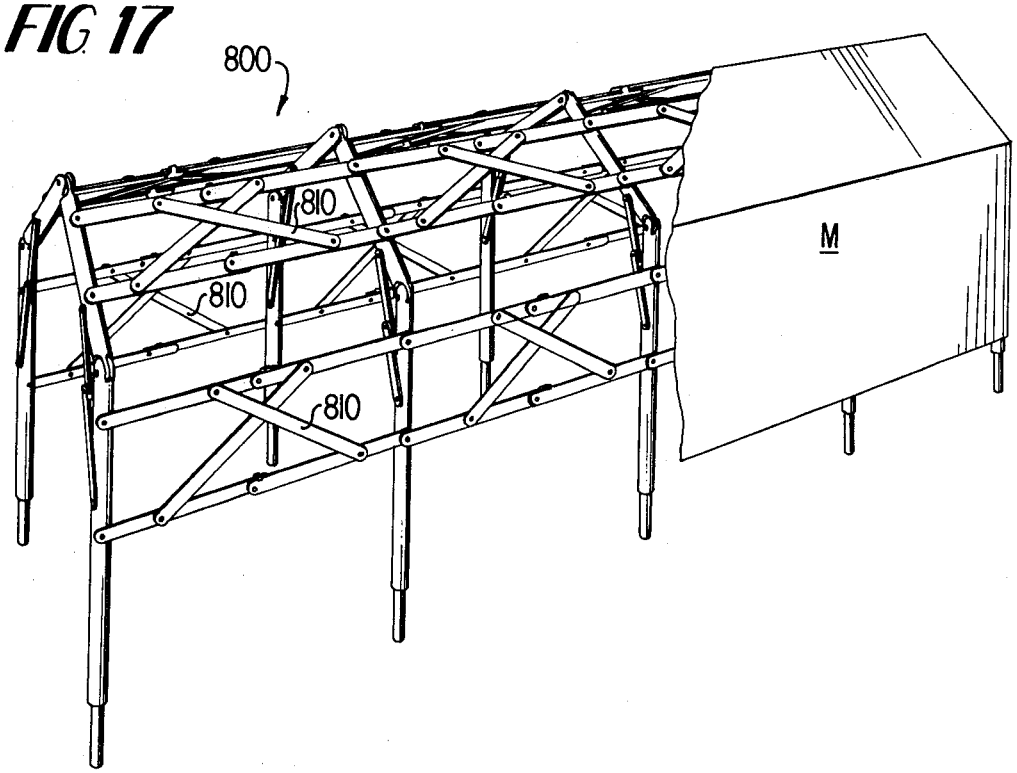
FIG. 17 is a perspective view of one embodiment of a portable collapsible structure utilizing the support structure of FIG. 1.

The term "vertical" used throughout the specification has been used in a general sense. It is not intended to limit the description to a member that forms a right angle with a horizontal member. For instance, it is contemplated that the support structure of the present invention can be positioned with the support mechanism interconnecting upstanding members that are not truly vertical. For example, the pitched roof of a garage, or barn or similar portable structure, which is designated 800 in FIG. 17, is constructed with a plurality of interconnected support mechanism 810 of the present invention. Also, each wall of the garage is formed by stacking one or more rows constructed of a plurality of interconnected support structures on top of each other. The roof is also constructed of one or more similar rows positioned on top of each other. It will be appreciated that the support structures forming the sides of the roof are angled towards each other so that they meet at the top of the roof. Suitable material, such as canvas, is attached to outer surfaces of the support mechanisms 810 to provide protection from the elements.

The invention has been described in detail with particular reference to preferred embodiments thereof, but it will be understood that variations and modifications can be effected within the spirit and scope of the invention.

What is claimed is:

1. A collapsible support structure for supporting a folding chair comprising two support members interconnected by a collapsible support mechanism, said support members having arcuate shaped lower ends facing each other, said collapsible support mechanism comprising:

first and second collapsible connecting members having first ends pivotally connected to a first of said two support members and second ends pivotally connected to a second of said two support members, a first of said connecting members being formed of two substantially equal length links having ends pivotally interconnected to each other, said first of said connecting members including locking means operative in an erected position of said support structure for maintaining a predetermined angular relationship between said links, the other of said connecting members being formed of a plurality of pivotally interconnected links, outer ends of said other connecting member being shaped to mate with and be pivotally interconnected to said lower ends of said support members, at least two of the links of said other connecting member having broad, substantially flat lower surfaces for supporting and distributing the weight of said support structure on a surface; and first and second cross bars extending between and pivotally connected to said first and second connecting members in such manner that said cross bars in an erected position of said support structure form a substantially X-shape and cooperate with said locking means to hold said support members in spaced-apart upstanding positions, said cross bars having off-set portions intermediate their ends to provide clearance between components of said support structure during collapse thereof.

2. A collapsible support structure according to claim 1 wherein the links of said first of said collapsible connecting members are interconnected in a region centrally located between the ends of said connecting member.

3. A collapsible support structure according to claim 1 further comprising spacer members positioned between selected components of said support structure to facilitate collapse of said support structure.

4. A collapsible support structure according to claim 1 further comprising means positioned between said collapsible support mechanism and said support members for automatically assisting movement of said support structure from a collapsed to an erected position.

5. A collapsible support structure according to claim 2, wherein the other of said collapsible connecting members comprises a longitudinally-extending U-shaped coupling plate and two links having facing proximal ends interconnected by said coupling plate, said coupling plate being positioned centrally between ends of said other connecting member.

6. A collapsible support structure according to claim 5, wherein said support members have arcuate shaped lower ends facing each other that are bifurcated to form holding members, and wherein said links of said other connecting member have distal ends inserted into said holding members.

7. A collapsible support structure according to claim 5 or 6, wherein the widths of said links of said other connecting members are greater than the widths of said links of said first connecting member.

8. A collapsible support structure according to claim 7, wherein said cross bars are connected to opposite sides of said connecting members.

* * * * *